United States Patent [19]

Makino et al.

[11] 4,007,342

[45] Feb. 8, 1977

[54] INTERNAL COMBUSTION ENGINE DISTRIBUTOR HAVING OXIDIZED ELECTRODES OR TERMINALS

[75] Inventors: Takayuki Makino, Okazaki; Masahiko Nagai, Toyota; Teruo Yamanaka, Toyota; Osamu Hori, Toyota, all of Japan

[73] Assignee: Toyota Jidosha Kogyo Kabushiki Kaisha, Toyota, Japan

[22] Filed: Apr. 10, 1975

[21] Appl. No.: 566,935

[30] Foreign Application Priority Data

June 25, 1974 Japan ..... 49-72663

[52] U.S. Cl. ..... 200/19 R; 123/146.5 A; 123/148 R; 200/19 DR; 200/19 DC; 200/266; 200/267

[51] Int. Cl.[2] ..... H01H 19/00; H01H 1/00

[58] Field of Search ... 200/19 DR, 19 DC, 262–270, 200/16 R; 313/146, 149; 423/325, 348; 75/148, 143, 160; 428/323, 328, 331, 446, 450; 123/146.5 A, 146.5 R, 148 R, 148 P

[56] References Cited

UNITED STATES PATENTS

| | | | |
|---|---|---|---|
| 1,494,597 | 5/1924 | Evans | 200/19 DR UX |
| 2,464,533 | 3/1949 | Shearer | 200/267 X |
| 2,861,155 | 11/1958 | Farnham et al. | 200/266 |
| 2,890,315 | 6/1959 | Graves, Jr. | 200/266 |
| 2,949,803 | 8/1960 | Leslie | 200/267 X |
| 3,017,532 | 1/1962 | Talmey | 200/266 X |
| 3,158,505 | 11/1964 | Sandor | 428/446 X |
| 3,209,298 | 9/1965 | Evanicsko, Jr. | 338/99 |
| 3,214,558 | 10/1965 | Huber | 200/267 |
| 3,604,877 | 9/1971 | Cockshutt | 200/267 X |
| 3,609,257 | 9/1971 | Jinsenji | 200/267 X |
| 3,949,721 | 4/1976 | Hori et al. | 123/146.5 A |

FOREIGN PATENTS OR APPLICATIONS 892,530 10/1953 Germany

OTHER PUBLICATIONS

Standard Handbook for Electrical Engineers, "Properties of Materials" pp. 438–443, ninth edition, 1957, McGraw–Hill.

*Primary Examiner*—James R. Scott
*Attorney, Agent, or Firm*—Stevens, Davis, Miller & Mosher

[57] ABSTRACT

A distributor containing an apparatus for suppressing noise is described, comprising an electrode of a distributor rotor and a group of electrodes of a plurality of stationary terminals which are arranged along a circular locus defined by the rotating distributor rotor keeping a constant spark discharging gap, wherein the surface of at least one of said electrodes of the distributor rotor and the stationary terminals is formed by an electrically high resistive material layer. The base layers for the electrodes and terminals are disclosed as made of silicon, brass, invar, steel and aluminum. The electrically high resistive layers are disclosed as made of silicon dioxide, copper oxide, aluminum oxide and invar oxide.

9 Claims, 24 Drawing Figures

Fig. 1
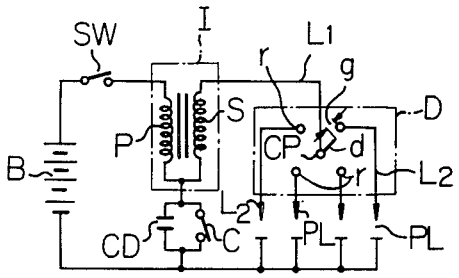
Fig. 2-a
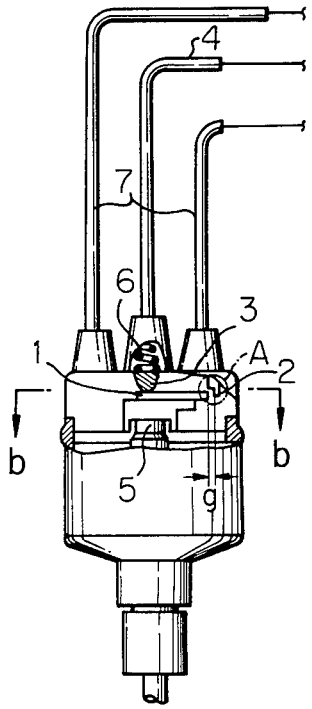
Fig. 2-b
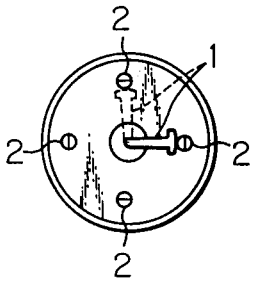

Fig. 3-a
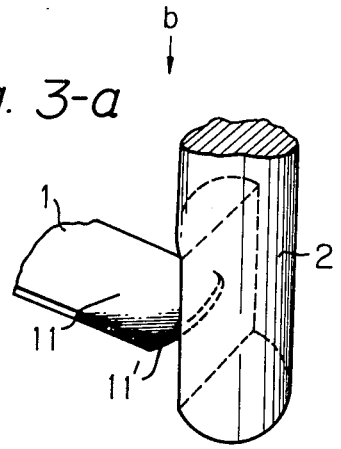
Fig. 3-b
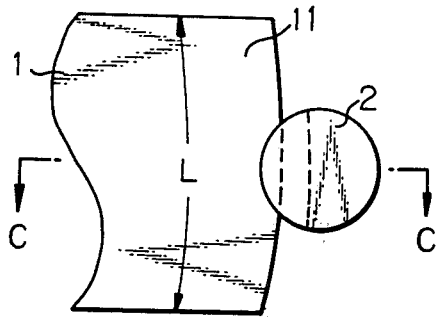
Fig. 3-c
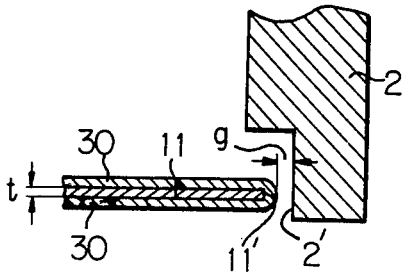

Fig. 4
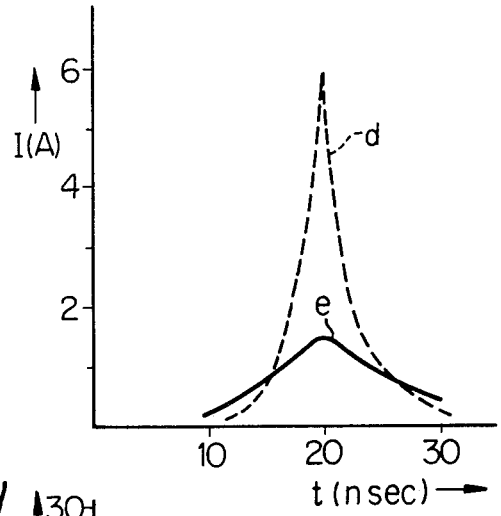
Fig. 5-H
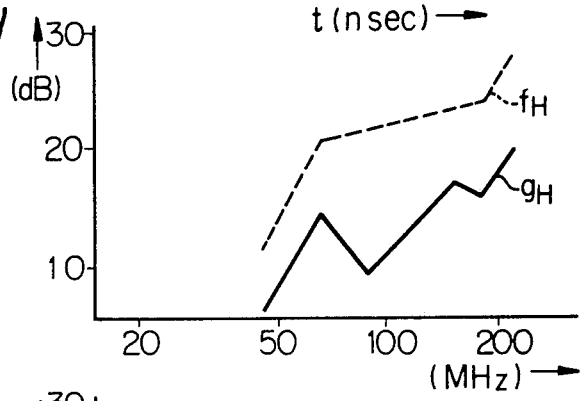
Fig. 5-V
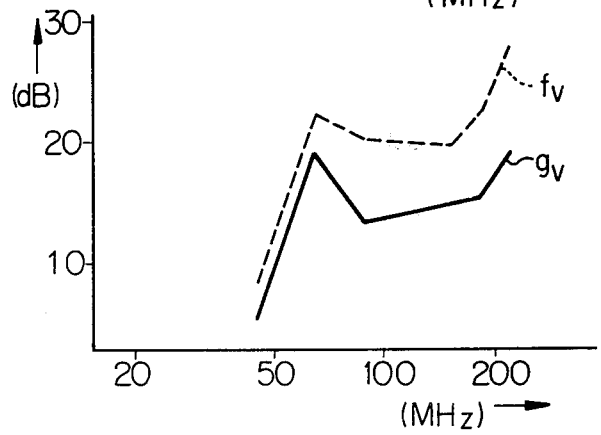

Fig 6-a
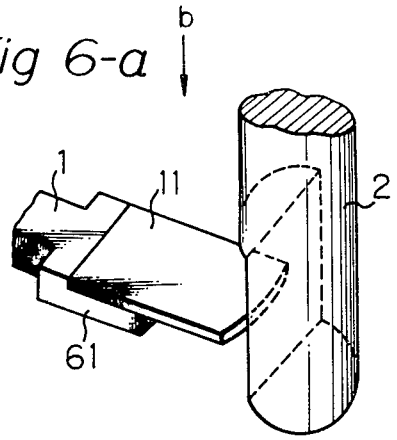
Fig. 6-b
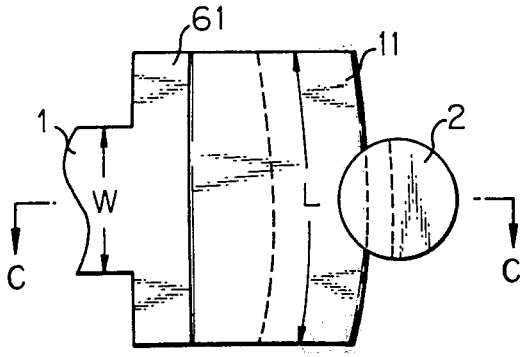
Fig. 6-c
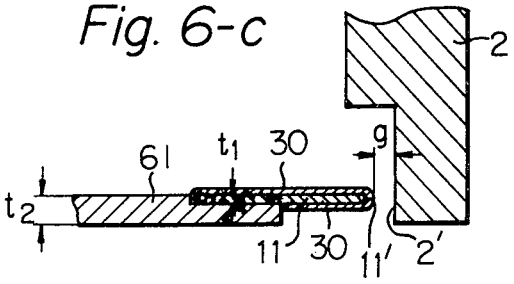

Fig. 7-a
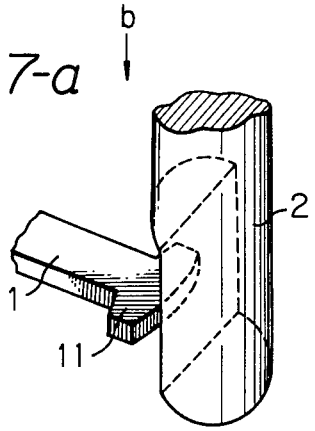
Fig. 7-b
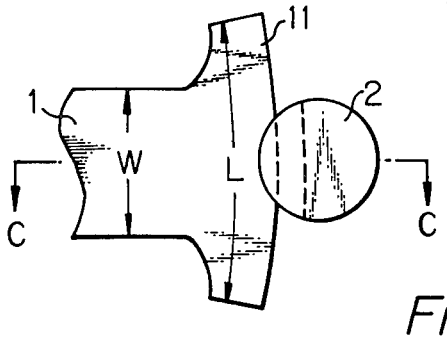
Fig. 7-c
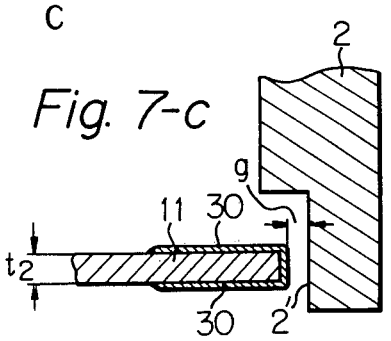
Fig. 8-c
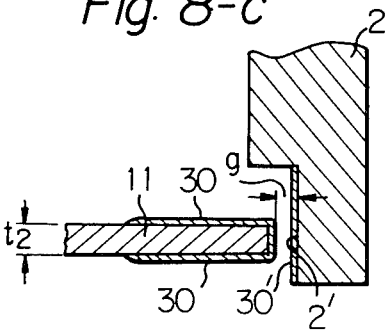

Fig. 9-a
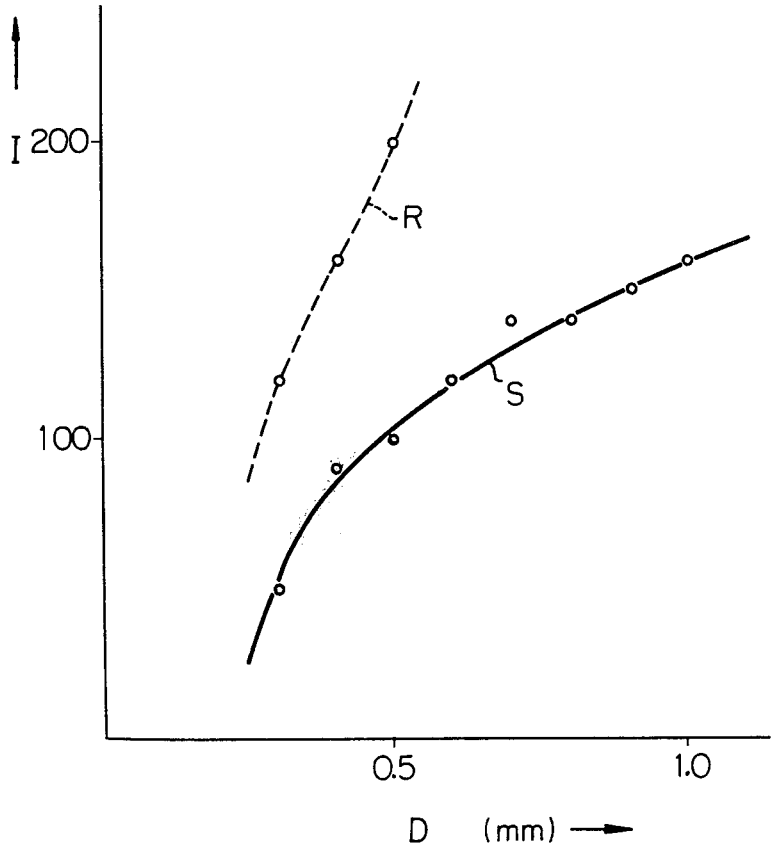

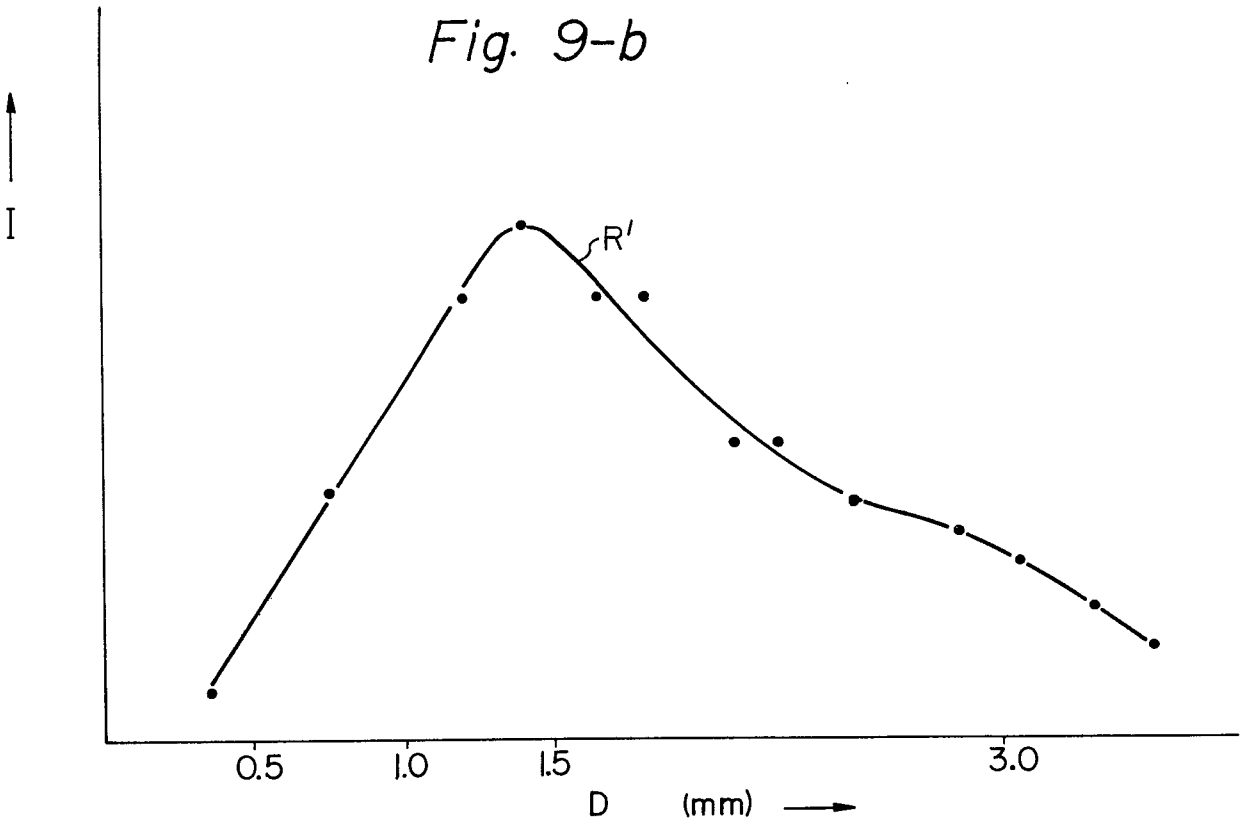
Fig. 9-b

Fig. 10-H
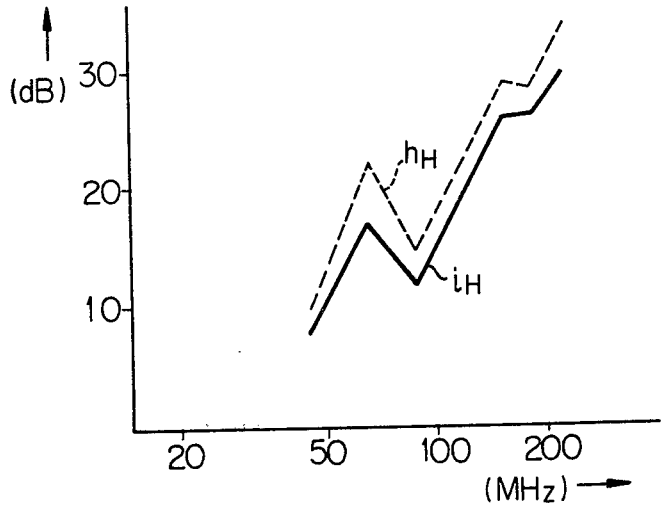
Fig. 10-V
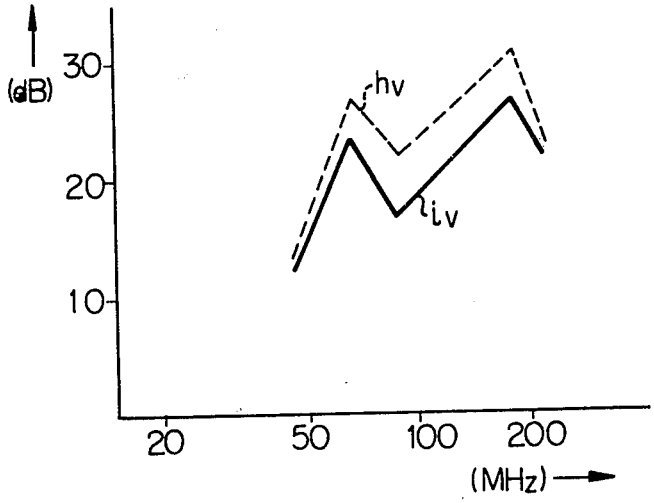

Fig. 11-a
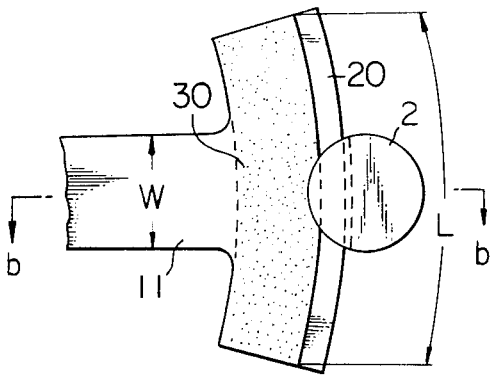
Fig. 11-b
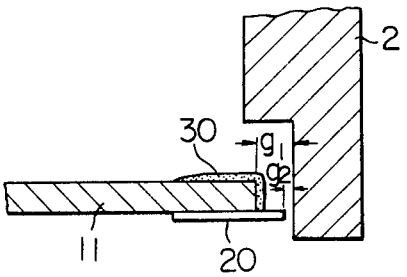

Fig. 12-H
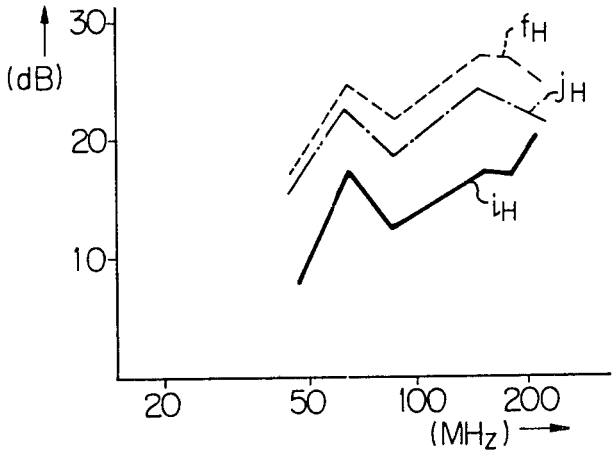
Fig. 12-V
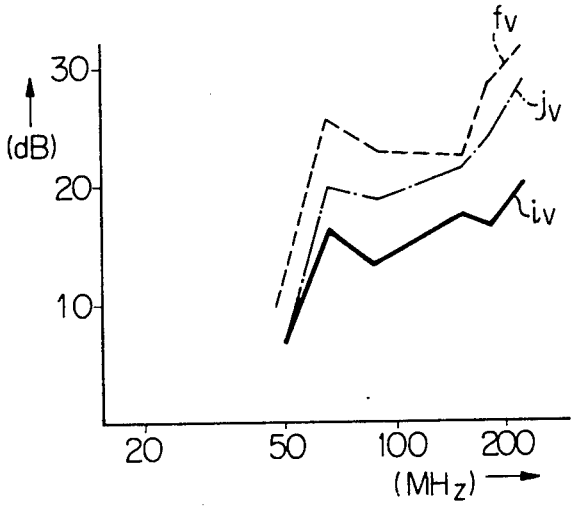

INTERNAL COMBUSTION ENGINE DISTRIBUTOR HAVING OXIDIZED ELECTRODES OR TERMINALS

The present invention relates generally to an apparatus for suppressing noise which radiates from the ignition system of an internal combustion engine, and more particularly relates to an apparatus for suppressing noise which generates from the electrodes of the distributor rotor and the stationary terminals, which are located in the distributor.

The igniter in which an electric current has to be intermitted quickly in order to generate a spark discharge, radiates the noise which accompanies the occurrence of the spark discharge. It is well known that the noise disturbs radio broadcasting service, television broadcasting service and other kinds of radio communication systems and as a result, the noise deteriorates the signal-to-noise ratio of each of the above-mentioned services and systems. Further, it should be recognized that the noise also causes operational errors in electronic control circuits which will undoubtedly be more widely and commonly utilized in the near future as vehicle control systems, for example E.F.I. (electronic controlled fuel injection system), E.S.C. (electronic controlled skid control system) or E.A.T. (electronic controlled automatic transmission system), and, as a result, traffic safety will be threatened. In addition, the tendency for an electric current flowing in the igniter to become very strong and to be intermitted very quickly to generate a strong spark discharge, will become a common occurrence because of the increasing emphasis on clean exhaust gas. However, strong spark discharge is accompanied by extremely strong noise which aggravates the previously mentioned disturbance and operational errors.

For the purpose of suppressing the noise, various kinds of apparatus or devices have been proposed. However, most of the proposed apparatus or devices are too expensive for practical use in mass-produced vehicles. Further, these apparatus or devices are not, in practice, reliable. One prior art which is considered to have practical value, is provided by the Japanese Patent No. 48-12012. In this Japanese Patent, the spark gap between the electrodes of the distributor rotor and the stationary terminal in the distributor is selected to be between 1.524(mm) and 6.35(mm), which is wider than the spark gap used in the typical distributor.

In the prior art, there are three kinds of typical apparatus for suppressing noise. A first typical one is the resistor which is S, L or K shaped and is attached to the external terminal of the spark plug. In some cases, a resistor is contained in the spark plug and hence, the spark plug is called a resistive spark plug. A second typical apparatus is also a resistor which is inserted in one portion of the high tension cable and hence, the cable is called a resistive high tension cable. A third typical apparatus is the noise suppressing capacitor. However, the prior art apparatus for suppressing noise, mentioned above, are defective in that although they can suppress noise to a certain intensity level, that level is not less than the noise level which must be suppressed in the fields of the above-mentioned broadcasting services, radio communication systems and electronic controlled vehicle control systems. Moreover, the noise suppressing capacitor has no effect on high-frequency noise.

Therefore, it is the principal object of the present invention to provide an apparatus for suppressing noise and to do so more effectively than that of the prior art.

Another object of the present invention is to provide a highly reliable apparatus for suppressing noise at a moderate price for use in vehicles which are mass-produced.

The present invention will be more apparent from the ensuing description with reference to the accompanying drawings wherein:

FIG. 1 is a typical conventional wiring circuit diagram of an igniter;

FIG. 2-*a* is a side view, partially cut off, showing a typical distributor;

FIG. 2-*b* is a sectional view taken along the line *b—b* of FIG. 2-*a;*

FIG. 3-*a* is a perspective view of a first embodiment according to the present invention;

FIG. 3-*b* is a plan view seen from the arrow b of FIG. 3-*a;*

FIG. 3-*c* is a sectional view taken along the line *c—c* of FIG. 3-*b;*

FIG. 4 is a graph showing changes of the current flow (in A), which is the so-called capacity discharge current, in the igniters both of the prior art and the present invention with respect to time (in ns);

FIGS. 5-H and 5-V are graphs showing changes of the noise-field intensity level (in dB) of the horizontal polarization and the vertical polarization, respectively, which are produced by the igniters both of the prior art and the present invention with respect to an observed frequency (in MHz);

FIG. 6-*a* is a perspective view of a second embodiment according to the present invention;

FIG. 6-*b* is a plan view seen from the arrow *b* of FIG. 6-*a;*

FIG. 6-*c* is a sectional view taken along the line *c—c* of FIG. 6-*b;*

FIG. 7-*a* shows a perspective view of the third through eighth embodiments;

FIG. 7-*b* is a plan view seen from the arrow *b* of FIG. 7-*a;*

FIG. 7-*c* is a sectional view taken along the line *c—c* of FIG. 7-*b*, but does not apply to the fifth embodiment;

FIG. 8-*c* is a sectional view taken along the line *c—c* of FIG. 7-*b* for the fifth embodiment;

FIGS. 9-*a* and 9-*b* are both graphs showing the effect on reducing a capacity discharge current I with respect to changes of a gap distance D of the spark discharging gap g;

FIG. 10-H and 10-V are graphs showing changes of the noise-field intensity level (in dB) of the horizontal polarization and the vertical polarization, respectively, with respect to an observed frequency (in MHz) using both one distributor to which one gap distance is applied and another distributor to which another gap distance is applied.

FIG. 11-*a* is a plan view of a ninth embodiment derived from the present invention;

FIG. 11-*b* is a sectional view taken along the line *b—b* of FIG. 11-*a;* and

FIGS. 12-H and 12-V are graphs showing changes of the noise-field intensity level (in dB) of the horizontal polarization and the vertical polarization, respectively.

FIG. 1 is a typical conventional wiring circuit diagram of the igniter, the construction of which depends on the well known battery type ignition system. In FIG. 1, a DC current which is supplied from the positive terminal of a battery B flows through an ignition switch SW, a primary winding P of an ignition coil I and a contact point C which connected in parallel to a capacitor CD, to the negative terminal of the battery B. When the distributor cam (not shown) rotates in synchronization with the rotation of the crank-shaft located in the internal combustion engine, the distributor cam cyclically opens and closes the contact point C. When the contact point C opens quickly, the primary current suddenly stops flowing through the primary winding P. At this moment, a high voltage is electromagnetically induced through a secondary winding S of the ignition coil I. The induced high-voltage surge, which is normally 10 – 30 (KV), leaves the secondary coil S and travels through a primary high tension cable $L_1$ to a center piece CP which is located in the center of the distributor D. The center piece CP is electrically connected to the distributor rotor d which rotates within the rotational period synchronized with said crank-shaft. Four stationary terminals *r*, assuming that the engine has four cylinders, in the distributor D are arranged with the same pitch along a circular locus which is defined by the rotating electrode of the rotor *d*, maintaining a small gap *g* between the electrode and the circular locus. The induced high-voltage surge is further fed to the stationary terminals *r* through said small gap *g* each time the electrode of the rotor *d* comes close to one of the four stationary terminals *r*. Then, the induced high-voltage surge leaves one of the terminals *r* and further travels through a secondary high tension cable $L_2$ to a corresponding spark plug PL, where a spark discharge occurs in the corresponding spark plug PL and ignites, the fuel air mixture in the corresponding cylinder.

It is a well known phenomenon that noise is radiated with the occurrence of a spark discharge. As can be seen in FIG. 1, three kinds of spark discharge occur at three portions in the igniter, respectively. A first spark discharge occurs at the contact point C of the contact breaker. A second spark discharge occurs at the small gap g between the electrode of the rotor *d* and the electrode of the terminal *r*. A third spark discharge occurs at the spark plug PL.

In various kinds of experiments, the inventors discovered that, among the three kinds of spark discharge, although the first and the third spark discharges can be suppressed ordinarily by the capacitor and the resistive spark plug respectively the second spark discharge, which occurs at the small gap g between the electrode of the rotor *d* and the electrode of the terminal *r*, still radiates the strongest noise compared with the first and the third spark discharges. This is because the second spark discharge includes a spark discharge, the pulse width of which is extremely small and the discharge current of which is extremely large. This spark discharge radiates the strongest noise from the high tension cables $L_1$ and $L_2$, which act as antennae.

The reason for the production of the spark discharge with an extremely small pulse width and an extremely large discharge current has already been explained in detail in U.S. Pat. No. 3,949,721. A summary of the above-mentioned reason is as follows. In FIG. 1, the high voltage of the induced high voltage surge from the secondary winding S appears at the rotor *d* not as a step-like wave but as a wave form in which the voltage at the rotor *d* increases and reaches said high voltage gradually with a time constant the value of which is decided mainly by the circuit constants of the ignition coil I and the primary high tension cable $L_1$ etc. When the voltage which appears at the rotor *d* increases and reaches a voltage which is sufficient to cause a spark discharge at the gap g between the electrodes of the rotor *d* and the terminal *r*, the spark discharge occurs and, at the same time, the electric charge which has been charged in a distributed capacity along the primary high tension cable $L_1$ moves to a distributed capacity along the secondary high tension cable $L_2$ through the spark discharge which is generally called a capacity discharge. The voltage level along the primary high tension cable $L_1$ momentary decreases at the occurrence of the capacity discharge. However, immediately after the capacity discharge the voltage at the spark plug PL increases gradually with a certain time constant, and when the voltage reaches a voltage level adequate to cause a spark discharge at the spark plug PL, the spark discharge occurs at the spark plug PL. Then one ignition cycle is completed. The spark discharge which occurs is generally called an inductive discharge.

Thus a spark discharge current which flows through the small gap *g*, is produced in accordance with the capacity discharge and the inductive discharge, respectively. Above all, it has been observed that the capacity discharge includes a great deal of discharge pulses with an extremely small pulse width and an extremely large discharge current, whereby the strongest noise which includes deleterious high frequency, is produced by said capacity discharge. Therefore, the basic ideas of the present invention are to transform the wave form of the capacity discharge with an extremely small pulse width and an extremely large discharge current into a wave form of a capacity discharge current with a relatively large pulse width and a relatively small discharge current. In other words, unstability of the former is improved by the latter and, consequently the deleterious high frequency components are considerably eliminated because of the stabilized capacity discharge current of the latter by the above-mentioned transformation of the wave form. It should be noted that the transformed capacity discharge current can suppress the maximum capacity discharge current and can stabilize the capacity discharge current.

The construction to realize the transformation of the wave form of the capacity discharge current according to the present invention will now be explained.

FIG. 2-*a* is a side view, partially cut off, showing a typical conventional distributor (corresponding to D in FIG. 1). And FIG. 2-*b* is a sectional view taken along the line *b*—*b* of FIG. 2-*a*. In FIGS. 2-*a* and 2-*b*, 1 indicates a distributor rotor (corresponding to *d* in FIG. 1), 2 indicates a stationary terminal (corresponding to *r* in FIG. 1) and the electrode of rotor 1 and the electrode of terminal 2 face each other with the small gap *g* (FIG. 2-*a*) between them. A center piece 3 (corresponding to CP in FIG. 1) touches the center portion of the rotor 1. The induced high voltage surge at the secondary winding S (FIG. 1) travels through a primary high tension cable 4 (corresponding to $L_1$ in FIG. 1) and the center piece 3 to the electrode of the rotor 1. A spring 6 pushes the center piece 3 downward to the rotor 1, thereby making a tight electrical connection between them. At the time when the electrode of the rotor 1, which is indicated by the solid line in FIG. 2-*b*, faces the terminal 2, the high voltage surge is fed to the terminal 2 through a spark discharge and is applied to the corresponding spark plug PL (FIG. 1) through a secondary high tension cable 7 (corresponding to $L_2$ in FIG. 1), where the fuel air mixture is ignited in the corresponding cylinder. When the rotor 1 rotates to the position indicated by the broken line in FIG. 2-*b*, and the electrode of the rotor 1 faces the next terminal 2, the high voltage surge is fed to the next terminal 2 through a spark discharge and is applied to the next corresponding spark plug PL (FIG. 1) through the other secondary high tension cable 7. In a similar way, the high voltage surge is sequentially distributed.

The present invention is applied to the elements which are surrounded by circle A indicated by the dot and bar line in FIG. 2-*a*. FIGS. 3, 6 and 7 are enlarged views of the elements which are surrounded by circle A in FIG. 2-*a*.

EMBODIMENT 1

FIG. 3-*a* is a perspective view showing the first embodiment according to the present invention. In FIG. 3-*a*, 11 indicates the electrode which is formed on the tip area of rotor 1 as one body with the rotor 1. A front surface 11′ of the electrode 11 faces a side surface 2′ (FIG. 3-*c*) of the stationary terminal 2 with a discharging gap *g* (FIG. 3-*c*) therebetween. art example 2 consists of a hollow or a solid circular shaft. The side surface 2′ of terminal 2, which faces the front surface 11′, is made by partially cutting off the circular shaft, and this side surface of the terminal acts as an electrode which cooperates with the electrode 11. FIG. 3-*b* is a plan view seen from the arrow *b* of FIG. 3-*a* and FIG. 3-*c* is a sectional view taken along the line *c*—*c* of FIG. 3-*b*. In FIG. 3-*c* the front surface 11′ of the electrode 11 faces the side surface 2′ of terminal 2 with a small air gap between them, thereby forming the spark discharging gap *g*. In the first embodiment: a gap distance of the spark discharging gap *g* is selected to be 1 (mm); the electrode 11 is made from silicon wafer, the resistivity of which is selected to be 60 – 80 (Ω·cm), the thickness of which, indicated by *t* in FIG. 3-*c*, is selected to be 0.3 (mm) and the width of which, indicated by L in FIG. 3-*b*, is selected to be 10 (mm). The noteworthy member in the distributor of the present invention is a layer which is plated or deposited on the surface of the electrode and is made from an electrically high resistive material. This layer is indicated by reference numeral 30 in FIG. 3-*c*. In this embodiment the high resistive material layer 30 is comprised of a surface oxide film of the electrode 11 itself and, accordingly, the layer 30 is composed of $SiO_2$. The surface oxide film (30) can easily be formed through a conventional oxidation process such as, for example, a process in which a silicon wafer, which has already been shaped to a configuration of a desired electrode 11, is exposed to high temperature atmosphere for a predetermined interval and, thereby the oxidized surface of the silicon wafer is obtained. This embodiment further requires a process through which electrical conductivity between the center piece 3 and the rotor 1, both shown in FIG. 2-*a*, is obtained. This is because the entire surface of the rotor 1 is covered by the high resistive oxide film 30. The requirement mentioned above can be satisfied by removing the oxide film of the portion at which the center piece 3 pushes against the rotor 1 by a conventional etching process. The portion where the silicon body is exposed by the etching process is coated by copper film through, for example, a conventional physical vapor deposition method and, then, a brass plate is soldered on the portion on which copper film has been coated. Thus the electric conductivity between the center piece 3 and the rotor 1 is obtained through the brass plate. The feature of the first embodiment is that the rotor 1 and also the electrode 11 are made from a silicon wafer as one body and the high resistive oxide layer 30 of the present invention is made from the surface oxide of the silicon wafer itself, thus providing the following advantage. In the first embodiment, noise suppressing ability is maintained stable for a long period. The reason for this is that even if a part of the surface oxide film 30 is broken off, another surface oxide film of silicon grows on the part where the surface oxide film 30 has broken off and renews the surface oxide film 30. The renewal of the surface oxide film 30 is achieved by a spark discharge which occurs at the spark discharging gap *g* (FIG. 3-*c*) during actual operation of the vehicle.

The effectiveness of the present invention in suppressing noise is now explained by taking the first embodiment as an example. However, it should be noted that the second through eighth embodiments, which will be explained hereinafter, are as effective in suppressing noise as the first embodiment. FIG. 4 is a graph showing the wave forms of a capacity discharging current, wherein the wave form indicated by the solid line *e* and the dotted line *d* respectively show, the changes of the capacity discharge current according to the present invention and the prior art. In FIG. 4, the coordinates indicate a capacity discharge current I (in A), and time (in ns). It should be clear from FIG. 4, that the maximum capacity discharge current I, indicated by the solid line *e*, according to the present invention, is considerably reduced, compared to the maximum capacity discharge current I, indicated by the dotted line *d*, according to the prior art. And further, the rise time and the pulse width of the capacity discharge current I, according to the present invention, are both considerably expanded, compared to those of the prior art. Thus, the capacity discharge current of the prior art which includes deleterious high frequency components and consequently radiates strong noise, is transformed to the capacity discharge current of the present invention which includes almost no deleterious high frequency components, and only feeble noise. The exact reason why the above-mentioned transformation of the capacity discharge current wave form can be accomplished, is not known, but one possible explanation is that a normal discharge at the spark discharging gap *g* between the electrode 11 and the terminal 2 cannot occur because of the intervention of the electrically high resistive material layer 30 which lies therebetween, and which interrups the flow of the discharge current.

As mentioned above, the rise time and the pulse width of the capacity discharge current are expanded simply by providing the electrically high resistive material layer between he spark discharging gap *g*, whereby both the deleterious high frequency components and the resultant strong noise are eliminated from the capacity discharge current. This will be clarified by referring to FIGS. 5-H and 5-V which are graphs clarifying the advantages of the present invention over the prior art, wherein the coordinates of FIG. 5-H indicate noise-field intensity of the horizontal polarization, and the frequency at which the noise-field intensity is measured respectively. The noise-field intensity is indicated in dB in which 0 (dB) corresponds to 1 (μV/m) and the frequency is indicated in (MHz). Further, in FIG. 5-V the abscissa is the same as explained in FIG. 5-H and the other coordinate indicates noise-field intensity of the vertical polarization waves which are measured by antennae arranged on a vertical. In FIGS. 5-H and 5-V, the performances of the present invention and the prior art are indicated by the solid lines $g_H$ and $g_V$, and the dotted lines $f_H$ and $f_V$, respectively. The measurements indicated by said solid lines and by said dotted lines were respectively obtained by using a vehicle which included a typical conventional resistive spark plug and a resistive high tension cable combined with the first embodiment of the present invention (FIG. 3) and by using a vehicle which includes only said typical conventional resistive spark plug and said resistive high tension cable. It should be quite clear from FIGS. 5-H and 5-V that the noise-field intensity produced from the igniter of the present invention is considerably minimized compared to that of the prior art igniter and it should be accordingly understood that the present invention remarkably suppresses strong noise. However, the art of forming the electrically high resistive layer 30 is not limited to the first embodiment (shown in FIG. 3) but can also be realized in either of the following embodiments.

EMBODIMENT 2

FIG. 6-*a* is a perspective view showing a second embodiment according to the present invention, FIG. 6-*b* is a plan view as seen from arrow *b* of FIG. 6-*a* and FIG. 6-*c* is a sectional view taken along the line *c*—*c* of FIG. 6-*b*, wherein all of the elements indicated in these figures basically correspond to the element referenced by the same numerals in FIGS. 3-*a*, 3-*b* and 3-*c*. The same applies to FIGS. 7-*a*, *b* and *c* and FIG. 8-*c*. In this second embodiment, the rotor 1 has a supporting member 61 on its tip portion. The supporting member 61 is formed as one body with said rotor 1 both of which are made of brass plate. The supporting member 61 supports the electrode 11 keeping a constant spark discharging gap *g* between a front surface 11′ of the electrode 11 and the side surface 2′ of the terminal 2. The electrode 11 is made from a silicon wafer the resistivity of which is 60 – 80 (Ω· cm). Further, the electrically high resistive material layer 30 is formed of a surface oxide film on the electrode 11 itself, said oxide layer 30 being composed of $SiO_2$, which is the same arrangement as that of the before mentioned first embodiment. Electrical conductivity between the rotor 1 and the electrode 11 is provided by removing the oxide layer 30 using the conventional etching process, and exposing the silicon body which was already formed on the part of the electrode 11 which will thereafter be fastened to the supporting member 61 by, for example, a well known electrically conductive adhesive. In addition, the electrode 11 can also be fastened to the supporting member 61 while keeping electric conductivity therebetween. In order to accomplish this, a copper film must be formed on the exposed silicon body by, for example, a conventional physical vapor deposition method, after removing said oxide layer 30, which exposes the silicon body. Then, the electrode 11 is soldered to the supporting member 61 through the copper film. The advantage of the second embodiment is that a distributor containing the noise suppressing apparatus of the second embodiment can be produced more economically than said apparatus of the first embodiment, since the first embodiment needs a great deal more silicon material than the second embodiment does. Furthermore, the second embodiment needs no special processing at the part of the rotor surface onto which the center piece 3 is pushed, unlike the first embodiment. In the second embodiment: the thicknesses of the supporting member 61 and the rotor 1, indicated by $t_2$ in FIG. 6-*c*, are both 1.0 (mm); the widths of the supporting member 61 and the electrode 11, indicated by L in FIG. 6-*b*, are both 10 (mm); the thickness of the electrode 11, indicated by $t_1$ in FIG. 6-*c*, is 0.3 (mm); the width of the rotor 1, indicated by W in FIG. 6-*b* is 5.0 (mm) and the other conditions such as the gap distance of the spark discharging gap *g* and the method for forming the surface oxide layer ($SiO_2$) 30 are the same as those of the first embodiment.

Embodiments 3 through 8 will be explained hereinafter by referring to FIGS. 7-*a*, 7-*b* and 7-*c*. Each of these embodiments has the same perspective view, plan view and sectional view. FIG. 7-*a* is a perspective view of the third, fourth, fifth, sixth, seventh and eighth embodiments, FIG. 7-*b* is a plan view seen from arrow *b* of FIG. 7-*a* and FIG. 7-*c* is a sectional view taken along the line *c*—*c* of FIG. 7-*b*. As shown in FIGS. 7-*a* and 7-*b*, the electrode 11 is formed on the tip portion of the rotor 1 as one body and the combined electrode 11 and the rotor 1 have a T-shaped configuration. In the third through eighth embodiments: the width of the electrode 11, indicated by L in FIG. 7-*b*, is 10 (mm); the width of the rotor 1, indicated by W in FIG. 7-*b*, is 5 (mm); the gap distance of the spark discharging gap *g* shown in FIG. 7-*c* is 1.0 (mm); the thicknesses of the rotor 1 and the electrode 11, indicated by $t_2$ in FIG. 7-*c*, are both 1.0 (mm) and; the conditions with respect to the terminal 2 are the same as those described in the first and second embodiments.

EMBODIMENT 3

Example 3-1

The electrode 11 is made from a brass plate and the outer periphery areas of said electrode 11 face the side surface 2′ which acts as an electrode of the terminal 2. Said areas are covered by an electrically high resistive layer 30. In this example, the electrically high resistive layer 30 is composed of copper oxide and is produced by the following processes. In the first process, copper powder is exposed in a high temperature atmosphere for a predetermined interval which produces copper oxide powder. In the second process, said produced copper oxide powder is sprayed onto the above-mentioned outer periphery areas of electrode 11, by the use of a plasma arc. Thus, the electrically high resistive layer 30 can be obtained the resistance of which is within the range of 10 (KΩ) to 200 (KΩ). This range was obtained by applying DC current to two measuring electrodes. One of the measuring electrodes was set on the surface of copper oxide layer 30, and another was set on the rotor 1. Each of the measuring electrodes is made of copper wire, the diameter of which is 1.4 (mm). The tip of the copper wire is needle-shaped. The advantages of the example 3-1 are as follows. The electrically high resistive layer 30 can be directly formed on conventional rotor 1 and electrode 11 without effecting any changes of these two members. Also, there is little danger of damage to the electrically high resistive material 30, because it is formed on the conventional rotor and electrode which are sturdy and mechanically dependable. As a result, a distributor containing noise suppressing apparatus can be obtained, which is suitable for mass-production and which can be produced at a relatively low cost.

Example 3-2

The construction of the example 3-2 is the same as that of example 3-1, except for the gap distance of each of the spark discharging gaps. The gap distance of example 3-1 is 1.0 (mm) while the gap distance of example 3-2 is 0.35 (mm). The advantage derived from shortening the gap distance of the spark discharging gap *g* will generally be apparent after referring to FIGS. **9-*a* and 9-*b*. FIGS. 9-*a* and 9-*b*** are both graphs showing the effects of the shortening the gap distance of the spark discharging gap *g*. In FIGS. **9-*a* and 9-*b***, the coordinates indicate the capacity discharge current I, and the gap distance D of the spark discharging gap *g* in mm. The capacity discharge current I are not indicated by absolute value but by relative value. The change in capacity discharge current I which is produced by using a conventional distributor, with respect to shortening the gap distance D, is indicated by the dotted line R in FIG. **9-*a*. The solid line R′ in FIG. 9-*b*, showing the capacity discharge current produced by using another conventional distributor, indicates the fact that the largest capacity discharge current is obtained when the gap distance D is about 1.4 (mm). The change in capacity discharge current I which is produced by using a distributor including the electrically high resistive material layer according to the present invention, with respect to shortening the gap distance D, is indicated by the solid line S in FIG. 9-*a*. From FIG. 9-*a* it can be seen that the more gap distance D is shortened, the more the capacity discharge current is minimized. In FIG. 9-*a*, relative capacity discharge current I from the conventional distributor (curve R) and from the present invention distributor (curve S) are, respectively, 200 and 100% when each of the gap distances D is 0.5 (mm). Further, it should be noted that the relative capacity discharge current I from the distributor of example 3-1 is 150% in which D is 1.0 (mm), while the relative capacity discharge current I from the distributor of example 3-2 is 50% in which D is 0.35 (mm). The measurements of the results in FIG. 9-*a* can be seen in FIGS. 10-H and 10-V**, which are graphs clarifying the fact that the more gap distance D of the spark discharging gap *g* is narrowed, the more the capacity discharge current is minimized resulting in the suppression of the noise-field intensity. The coordinates of FIG. 10-H indicate noise-field intensity of horizontal polarized waves, and which also indicate the frequency at which the noise-field intensity is measured. The noise-field intensity is indicated in dB in which 0 (dB) corresponds to 1 ($\mu$V/m) and the frequency is indicated in (MHz). Further, in FIG. 10-V one of the coordinates indicates noise-field intensity of vertical polarized waves, and the other of the coordinates is the same as explained in FIG. 10-H. In FIGS. 10-H and 10-V, the measurements indicated by solid lines ($i_H$ in FIG. 10-H and $i_V$ in FIG. 10-V) were obtained by using a distributor based on example 3-2 in which a conventional resistive spark plug and a conventional resistive high tension cable were used. The gap distance D of the spark discharging gap *g* was 0.35 (mm). The measurement indicated by dotted lines ($h_H$ in FIG. 10-H and $h_V$ in FIG. 10-V) were obtained by using a distributor which is based on example 3-1, together with said conventional resistive spark plug and resistive high tension cable. The gap distance D of the spark discharging gap *g* was not 0.35 (mm) but 0.7 (mm). It should be quite clear from FIGS. 10-H and 10-V that the noise suppressing ability is most effective when the electrode 11 of the distributor is formed with an electrically high resistive material layer 30, when at the same time gap distance D of the spark discharging gap *g* is shortened as much as possible.

EMBODIMENT 4

The electrode 11 is made from a brass plate and the outer periphery areas of said electrode 11 face the side surface 2′ which surface 2′ acts as an electrode of the terminal 2. Said areas are covered by an electrically high resistive layer 30. In a fourth embodiment, the electrically high resistive layer 30 is composed of aluminum oxide and is produced by the following processes. In the first process, aluminum powder is exposed in a high temperature atmosphere for a predetermined interval which produces aluminum oxide powder. In the second process said produced aluminum oxide powder is sprayed onto the above-mentioned outer periphery areas of the electrode 11 by the use of a plasma arc. Thus, the electrically high resistive layer 30 is obtained, the resistance of which is within the range of 10 (KΩ) to 200 (KΩ). This range was obtained by applying DC current to two measuring electrodes. One of the measuring electrodes was set on the surface of the aluminum oxide layer 30, and another was set on the rotor 1. Each of the measuring electrodes is made from copper wire the diameter of which is 1.4 (mm). The tip of the copper wire is needle-shaped. The advantages of the fourth embodiment are as follows. The electrically high resistive layer 30 can be directly formed on the conventional rotor 1 and electrode 11 without effecting any changes of these two members. There is little danger of damage to the electrically high resistive material layer 30 because it is formed on the conventional rotor and electrode which are sturdy and mechanically dependable. As a result, a distributor containing noise suppressing apparatus can be obtained, which is suitable for mass-production and which can be produced at a relatively low cost.

EMBODIMENT 5

In a fifth embodiment, the electrically high resistive material layer 30 is formed on not only the surface of the electrode 11 of the rotor 1, but also on the side surface 2′ of the terminal 2. Consequently, the sectional view taken along the line *c—c*of FIG. **7-*b* is changed in FIG. 8-*c* in which the additional electrically high resistive material layer (FIG. 8-*c*) is indicated by reference numeral 30′. In the fifth embodiment, the electrode 11 is made of brass plate and the terminal 2 is made from an aluminum circular rod having a diameter of 4.0 (mm). Each of the electrically high resistive material layers 30 and 30′ is composed of copper oxide which is formed in same processes as mentioned before in example 3-1 of the third embodiment. That is, in the first process, copper powder is exposed in high temperature atmosphere for a predetermined interval which produces copper oxide powder. Said produced copper oxide powder is sprayed onto the above-mentioned outer periphery areas of electrode 11, by the use of a plasma arc. Thus, the electrically high reisistive material layer 30 is obtained, the resistance of which is within the range of 10 (KΩ) – 200 (KΩ). This range was determined by applying DC current to two measuring electrodes. One of the measuring electrodes was set on the surface of the copper oxide layer (30, 30') and another was set on the rotor 1 or terminal 2. Each of said measuring electrodes is made from copper wire, the diameter of which is 1.4 (mm). The tip of the copper wire is needle-shaped. The advantages of this embodiment are as follows. The electrically high resistive material layers 30 and 30' are able to be directly formed on conventional rotor 1 and electrode 11, and conventional side surface 2', respectively, without effecting any changes on these members 1, 11 and 2'. Also, there is little danger of damage to the electrically high resistive material layers 30 and 30' because they are formed on the conventional electrodes of the rotor and the stationary terminal which are sturdy and mechanically dependable. As a result, a distributor containing noise suppressing apparatus can be obtained, which is suitable for mass-production and which can be produced at a relatively low cost. In addition, the effectiveness of suppressing the capacity discharge current is more remarkable in this embodiment than in any other, because the electrically high resistive material layer is formed on both the electrodes 11 and 2'. It should be noted that the arrangement of the fifth embodiment shown in FIG. 8-*c*** can also be applied to other embodiments according to the present invention.

EMBODIMENT 6

The feature of a sixth embodiment is that an ageing process is further applied to the electrically high resistive material layer which was formed on each of the electrodes of example 3-1 and of the fourth and fifth embodiments, also.

Example 6-3-1

The ageing process is applied to an electrically high resistive material layer 30 which was formed on an electrode 11 in accordance with example 3-1. The ageing process is performed by blowing a random arc jet onto the electrically high resistive material layer 30 which is composed of copper oxide, for two hours during which the electrode 11 on which said copper oxide layer 30 is formed, is rotated at a predetermined pace.

Example 6-4

The ageing process is applied to the electrically high resistive material layer 30 which was formed on an electrode 11 in accordance with the fourth embodiment. The ageing process is performed by blowing a random arc jet onto the electrically high resistive material layer 30 which is composed of aluminum oxide for two hours during which the electrode 11 on which said aluminum oxide layer 30 is formed, is rotated at a predetermined pace.

Example 6-5

The ageing process is applied to electrically high resistive material layers 30 and 30' which were respectively formed on an electrode 11 of a rotor 1 and an electrode 2', that is a side surface of a terminal 2 in accordance with the fifth embodiment. The ageing process is performed by blowing a random arc jet onto both the electrically high resistive material layers 30 and 30' which are composed of copper oxide, for two hours during which the electrodes 11 and 2' on which said copper oxide layers 30 and 30' are respectively formed, are rotated at a predetermined pace.

The resistance values of the aged high resistive material layers of the above-mentioned examples 6-3-1, 6-4 and 6-5 are all within the range of 10 (KΩ) – 1000 (KΩ), which was obtained in the before-mentioned manner. The measuring electrodes are also the same as before-mentioned.

The above-mentioned sixth embodiment has the same advantage as that mentioned in the third, fourth and fifth embodiments and also has the further advantage that the effect on reducing the capacity discharge current can be maintained stable for a long period. This is because, the electrically high resistive material layer onto which the ageing has been applied, is physically stout and stable.

EMBODIMENT 7

In a seventh embodiment, the rotor 1 and the electrode 11 are made of an electric resistance alloy such as an invar composed of 36 weight % of Ni and 64 weight % of Fe. The electrically high resistive material layer 30 is formed of a surface oxide film on the electrode 11 itself, said oxide film being composed of invar oxide. The surface oxide film 30 can easily be formed through a conventional oxidation process such as, for example, a process in which an invar wafer which has already been shaped to the desired configuration of electrode 11, is exposed in a high temperature atmosphere for a predetermined interval, after which an oxidized surface of the invar wafer can be obtained. The resistance of the high resistive material layer 30 is within the range of 1 (MΩ) – 5 (MΩ), which range is obtained in the same manner and measured by the same kind of electrodes as before-mentioned. The advantages of the seventh embodiment are as follows. One advantage is that the effectiveness of reducing the capacity discharge current increases compared to other embodiment. This is because the flow of the capacity discharge current is suppressed by not only the electrically high resistive layer 30, but also by the electric resistance value of the bodies of the rotor 1 and electrode 11 which are made of high resistive invar. Another advantage is that the noise suppressing ability is stably maintained over a long period. This is because, even if a part of the surface oxide film 30 is broken off, another surface oxide film of invar will grow on said part, thereby renewing the surface oxide film 30. The renewing of the surface oxide film 30 is achieved by a spark discharge which occurs at the spark discharging gap *g* (FIG. **7-*c***) during the actual operation of the vehicle.

EMBODIMENT 8

The feature of an eighth embodiment is that the electrode 11 and/or the electrode 2' are made of steel. The advantage of the eight embodiment is as follows. The electrically high resistive material layer 30 composed of copper oxide or aluminum oxide which is formed using the same processes as mentioned before in example 3-1 or the third embodiment, is tightly stuck onto the steel electrode 11 or 2' and, consequently, a partial exfoliation of the high resistive material layer 30 or 30' from steel electrode 11 or 2' can not occur. As a result the effectiveness of noise suppression can be stably maintained for a long period.

Futhermore, from various kinds of experiments concerning the first through sixth embodiments, it was discovered that strong noise can be more effectively suppressed by using in combination, the electrically high resistive material layer of the present invention with a dielectric member. Said dielectric member is attached to the electrode 11 and/or the terminal 2 by, for example, a well-known adhesive.

FIG. 11-*a* is a plan view of a ninth embodiment based on the new fact which is mentioned above. FIG. 11-*b* is a sectional view taken along the line *b*—*b* of FIG. 11-*a*. In FIG. 11-*b*, the reference numeral 20 indicates said dielectric member. The reference numeral 30 indicates the electrically high resistive layer of the present invention. The outer periphery of the dielectric member 20 faces the side surface of the terminal 2 with a small gap distance $g_2$. And the outer periphery of the electrically high resistive layer 30 faces the side surface of the terminal 2 with a large gap distance $g_1$ ($g_1 > g_2$). In this embodiment: the dielectric member 20 is made of mica the thickness of which is 0.3 (mm); the electrode 11 is made of a brass plate, the thickness of which is 1.0 (mm); the gap distances $g_1$ and $g_2$ are 1.2 (mm) and 0.2 (mm), respectively, and; the layer 30 is made of copper oxide by a metal spray process as mentioned previously.

FIGS. 12-H and 12-V are graphs clarifying the advantage of said dielectric member 20 in the ninth embodiment, wherein the ordinate of FIG. 12-H indicates noise-field intensity of the horizontal polarization and the abscissa indicates an observed frequency of the noise. Said noise-field intensity is indicated in dB in which 0 (dB) corresponds to 1 ($\mu$v/m) and the frequency is indicated in ($MH_z$). In FIG. 12-V the ordinate indicates the noise-field intensity of the vertical polarization, and the abscissa is the same as explained in FIG. 12-H. In FIGS. 12-H and 12-V, the performance of the ninth embodiment having the dielectric member 20 is indicated by the thick solid line $i_H$ in FIG. 12-H and $i_V$ in FIG. 12-V. The dotted lines $f_H$ and $f_V$ were obtained by using a vehicle having only typical conventional resistive spark plugs and resistive high tension cable. The chain dotted lines $j_H$ and $j_V$ were obtained by using said vehicle wherein typical conventional high resistive spark plugs, resistive high tension cable with the addition of an electrically high resistive material layer 30 are included.

It should be understood from FIGS. 12-H and 12-V that the effect for suppressing noise can be obtained by using either the dielectric member 20 or the electrically high resistive material layer 30 which provides characteristic curves $j_H$ and $j_V$. However, the suppressing of noise is most effective when the dielectric member 20 and the electrically high resistive material layer 30 are used together in one distributor as shown by curves $i_H$ and $i_V$.

As mentioned above, the distributor acccording to the present invention is extremely effective in suppressing noise intensity and further, it can be industrially realized. Moreover, it should be noted that the distributor according to the present invention can be applied to an internal combustion engine, together with the typical conventional apparatus for suppressing noise such as the resistive spark plug and/or the resistive high tension cable, since the typical conventional apparatus for suppressing noise is beneficial to the distributor of the present invention without interference.

What is claimed is:

1. A distributor for an internal combustion engine, containing an apparatus for suppressing noise, comprising:

a distributor rotor which is electrically connected to a high voltage generator included in an ignition circuit of the internal combustion engine, said rotor comprising an electrode;

a plurality of stationary terminals, each of which comprises an electrode, is electrically connected to a corresponding spark plug, and is arranged along a circular locus defined by the rotating distributor rotor with a discharging gap between the electrodes of the terminals and the electrode of the distributor rotor, and the surface of at least one of the electrodes of the distributor rotor and the stationary terminals is formed by an electrically high resistive layer of an oxide.

2. A distributor for an internal combustion engine, containing an apparatus for suppressing noise as set forth in claim 1, comprising:

the electrode of the distributor rotor;

the group of electrodes of the stationary terminals and;

the electrically high resistive layer, which is formed on the surface of at least one of the electrodes of the distributor rotor and the stationary terminals, whereon at least one of said electrodes is composed of a member selected from the group consisting of brass and steel.

3. A distributor for an internal combustion engine, containing an apparatus for suppressing noise as set forth in claim 1, comprising:

the electrode of the distributor rotor;

the group of electrodes of the stationary terminals and;

the electrically high resistive layer, which is formed on the surface of at least one of the electrodes of the distributor rotor and the stationary terminals, whereon at least one of said electrodes is made of silicon.

4. A distributor for an internal combustion engine, containing an apparatus for suppressing noise as set forth in claim 1, comprising:

the electrode of the distributor rotor;

the group of electrodes of the stationary terminals and;

the electrically high resistive layer, which is formed on the surface of at least one of the electrodes the distributor rotor and the stationary terminals, whereon at least one of said electrodes is made of invar.

5. A distributor for an internal combustion engine, containing an apparatus for suppressing noise as set forth in claim 2, wherein said electrically high resistive layer is composed of a member selected from the group consisting of copper oxide and aluminum oxide.

6. A distributor for an internal combustion engine, containing an apparatus for suppressing noise as set forth in claim 3, wherein said electrically high resistive layer is formed by oxidizing the surface of the silicon body electrode.

7. A distributor for an internal combustion engine, containing an apparatus for suppressing noise as set forth in claim 4, wherein said electrically high resistive layer is formed by oxidizing the surface of the invar body electrode.

8. A distributor for an internal combustion engine, containing an apparatus for suppressing noise as set forth in claim 5, wherein said electrically high resistive layer is treated with an ageing process.

9. A distributor for an internal combustion engine, containing an apparatus for suppressing noise, comprising:

a distributor rotor which is electrically connected to a high voltage generator included in an ignition circuit of the internal combustion engine, said rotor comprising an electrode;

a plurality of stationary terminals, each of which comprises an electrode, is electrically connected to a corresponding spark plug, and is arranged along a circular locus defined by the rotating distributor rotor with a discharging gap between the electrodes of the terminals and the electrode of the distributor rotor, and the surface of at least one of the electrodes of the distributor rotor and the stationary terminals is formed by an electrically high resistive layer composed of a member selected from the group consisting of silicon dioxide, copper oxide, aluminum oxide and invar oxide.

* * * * *